US009080801B2

(12) United States Patent
Arjomand

(10) Patent No.: US 9,080,801 B2
(45) Date of Patent: Jul. 14, 2015

(54) WINDOW REFRIGERATOR

(76) Inventor: Ray Arjomand, New York, NY (US)

( * ) Notice: Subject to any disclaimer, the term of this patent is extended or adjusted under 35 U.S.C. 154(b) by 1835 days.

(21) Appl. No.: 11/474,530

(22) Filed: Jun. 26, 2006

(65) Prior Publication Data

US 2006/0288729 A1 Dec. 28, 2006

Related U.S. Application Data

(60) Provisional application No. 60/758,299, filed on Jan. 12, 2006, provisional application No. 60/694,328, filed on Jun. 27, 2005.

(51) Int. Cl.

| | |
|---|---|
| ***F25D 11/02*** | (2006.01) |
| ***F25D 11/00*** | (2006.01) |
| ***F25D 23/12*** | (2006.01) |
| ***F25D 1/00*** | (2006.01) |
| ***F24F 1/02*** | (2011.01) |
| ***F24F 5/00*** | (2006.01) |
| *F25B 13/00* | (2006.01) |

(52) U.S. Cl.

CPC . *F25D 1/00* (2013.01); *F24F 1/027* (2013.01); *F24F 5/0096* (2013.01); *F25D 11/006* (2013.01); *F25D 23/12* (2013.01); *F25B 13/00* (2013.01)

(58) Field of Classification Search

CPC ..... F24F 1/027; F24F 5/0096; F25B 13/00; F25D 23/12; F25D 11/006; F25D 1/00

USPC ..... 62/262, 263, 186, 59

See application file for complete search history.

(56) References Cited

U.S. PATENT DOCUMENTS

| | | | | |
|---|---|---|---|---|
| 2,984,086 | A * | 5/1961 | Wertheimer | 62/262 |
| 3,123,986 | A | 3/1964 | Lukas | |
| 3,916,639 | A | 11/1975 | Atkinson | |
| 3,979,922 | A * | 9/1976 | Shavit | 62/97 |
| 4,448,346 | A * | 5/1984 | Kuwaki et al. | 236/46 R |
| 4,821,530 | A | 4/1989 | Ledbetter | |
| 5,036,904 | A * | 8/1991 | Kanda et al. | 165/10 |
| 5,355,693 | A | 10/1994 | McConnell | |
| 5,577,822 | A * | 11/1996 | Seon | 312/404 |
| 6,347,526 | B1 | 2/2002 | Ledbetter | |
| 6,463,752 | B2 * | 10/2002 | Mandel et al. | 62/382 |
| 7,334,684 | B1 * | 2/2008 | Fontanilla et al. | 206/541 |
| 2002/0166333 | A1 * | 11/2002 | Sakurai et al. | 62/197 |

FOREIGN PATENT DOCUMENTS

| | | | |
|---|---|---|---|
| JP | 03263576 | A * | 11/1991 |
| JP | 06300416 | A * | 10/1994 |

* cited by examiner

*Primary Examiner* — Frantz Jules
*Assistant Examiner* — Webeshet Mengesha

(57) ABSTRACT

A refrigerator having its heat exchanger outdoors. In one embodiment, a thermos is attached to the front of a window air conditioner. In another embodiment, the refrigerator has gated conduits to allow cold outdoor air into the refrigerator. The refrigerator has a compressor that circulates refrigerant in an auxiliary evaporator adjacent to the refrigerator compartment to freeze the water in the refrigerator at night and to allow the ice to keep the refrigerator cold. In another embodiment, the refrigerator is combined with a heat pump such that the outdoor heat exchanger of the heat pump and the outdoor heat exchanger of the refrigerator are in close thermal contact. Another embodiment includes a heat pump having a second evaporator near the refrigerator compartment to cool the inside of the refrigerator compartment and heat the home simultaneously by transferring the heat from inside the refrigerator to the indoors.

7 Claims, 14 Drawing Sheets

110
50F
75F
112
34F
108
50F 26
50F
75F
112
108
34F
50F 110
50F
75F
112
42F
108
50F 50F
75F
112
108
42F
26
50F

WINDOW REFRIGERATOR

CROSS-REFERENCE TO RELATED APPLICATIONS

This application is based on provisional application No. U.S. 60/758,299, dated Jan. 12, 2006 entitled "Window Refrigerfator and Hybrid Window Refrigerator and Air Conditioner" and provisional application No. U.S. 60/694,328, dated Jun. 27, 2005 entitled "Window Refrigerator and Air Conditioner", which corresponds to Disclosure Document No. 577575, entitled "Window Refrigerator And Air Conditioner", dated May 13, 2005. It also corresponds to Disclosure Document No. 595989, entitled "Air Conditioner At Night Forms Ice Around Condenser", dated Mar. 6, 2006.

STATEMENT REGARDING FEDERALLY SPONSORED RESEARCH OR DEVELOPMENT (Not applicable)

REFERENCE TO SEQUENTIAL LISTING, A TABLE, OR A COMPUTER PROGRAM LISTING APPENDIX SUBMITTED ON A COMPACT DISC (Not applicable)

BACKGROUND OF THE INVENTION

1) Field of the Invention

This invention relates generally to the field of refrigerators and heat pumps/air conditioners; and, more specifically, it discloses a stand-alone window refrigerator that has its condenser coil placed outdoors. Like a window air conditioner (A/C), a window refrigerator's back (its air-cooled condenser) is set outdoors to save electricity whenever the kitchen is warmer than the outdoors (which, because of the oven, the indoor refrigerator, and the dishwasher, is most of the time). In addition, in the winter, cold outdoor air can be used to cool the inside of the refrigerator. During the hot summer months, this device can be used as both a refrigertor/freezer (R/F) and an indoor cooling and de-humidifying device; and in winter as an indoor heating-humidifying device.

A refrigerator may also be built into a through-the-wall heat pump, which is usually installed under the window through an opening in the wall. Some heat pumps have both cooling and heating elements as are often found in hotel rooms, condominiums, and office buildings. Another variation can be a thermos that is attached to the front of the window A/C.

2) Description of the Related Art

A heat pump is a machine which transfers or moves heat from a low temperature reservoir to a higher temperature reservoir under supply of work. Refrigerators, freezers, air conditioners, and some heating systems are all common applications of heat pumps. They all have the same internal components: compressor, condenser, refrigerant, evaporator, pump, motor and fan. In the summer, a heat pump serves as an A/C by absorbing heat from indoor air and pumping it outdoors. In the winter, it does the reverse by absorbing heat from outdoor air and pumping it indoors. An A/C is basically a refrigerator without the insulated box. Refrigerators and A/Cs are both examples of heat pumps operating only in the cooling mode. A refrigerator is essentially an insulated box with a heat pump system connected to it. The evaporator coil is located inside the box, usually in the freezer. Heat is absorbed from this location and transferred outside, usually behind or underneath the unit where the condenser coil is located. Similarly, an A/C transfers heat from inside a house to the outdoors.

The most common heat pump efficiency measurement is called the Coefficient of Performance, or COP. The COP is the ratio of the heat pump's BTU heat output to the BTU electrical input. The higher the COP, the better; because more heat can be transferred using less work (electricity). The COP depends primarily on the temperatures of the evaporator (inside the R/F) and the condenser (on the back of the R/F). The closer the two temperatures, the higher the COP. Therefore, the colder the outside temperature gets, the closer it gets to the inside temperature of the R/F, and the higher the efficiency of the window R/F relative to a similar indoor R/F.

Operation of an A/C at elevated ambient temperatures inherently results in a lower COP. Generally speaking, when cooling, for each 1° C. reduction in air-conditioning temperature, energy consumption goes up about 10%. This conclusion comes directly from examining the Carnot cycle. The COP relation, COP=Tevap/(Tcond−Tevap), indicates that the COP decreases when the condenser temperature increases at a constant evaporation temperature. This theoretical indication derived from the reversible cycle is valid for all refrigerants. For refrigerants operating in the vapor compression cycle, the COP degradation is greater than that for the Carnot cycle and varies among fluids. The two most influential fundamental thermodynamic properties affecting this degradation are a refrigerant's critical temperature and its molar heat capacity (e.g., McLinden, 1987; Domanski, 1999). For a given application, a fluid with a lower critical temperature will tend to have a lower COP.

Conversely, the COP for a heat pump decreases as the outdoor temperature decreases, because it is more difficult to extract heat from cooler air. Conventional electric resistance heaters have a COP of 1.0. This means it takes one watt of electricity to deliver the heat equivalent of one watt. Air-source heat pumps generally have COPs ranging from 2 to 4; they deliver two to four times more energy than they consume. Water and ground source heat pumps normally have COPs of somewhere between 3 and 5.

According to the US Energy Information Administration's website, in 2001, refrigerators consumed 14% of the total amount of electricity in the average US household—the most of all appliances (the separate freezer unit consumed an additional 3%). The refrigerator consumes more electricity than the computer, computer monitor, television, printer, copier, and clothes dryer. It even consumes more electricity per year than the window or room A/C (2%). This is because, unlike the A/C, the refrigerator is a necessity that is never turned off.

When it is 100° F. outdoors, the window A/C consumes much more electricity (its COP is lower) than when it is 80° F. outdoors. The same is true of a window refrigerator. When the outdoor temperature is 60° F., 50° F., 40° F., or 30° F., the window refrigerator consumes far less electricity (its COP is much greater) than an indoor refrigerator that is in a 70° F. or 80° F. kitchen day and night all year. Indoor refrigerators generate noise and heat. The heat warms the indoor space in the hot summer months, adding to the discomfort.

The indoor refrigerator works against the A/C, warming the home and wasting electricity. In the summer, a window refrigerator/freezer (R/F) does not heat the home (work against the A/C) as does an indoor refrigerator. Even when the A/C is on, the kitchen is often warmer than the outdoors. People use the window A/C to cool their living space (not the kitchen). The R/F is placed in the kitchen near the oven and the dishwasher. Because of the oven, the indoor refrigerator and the dishwasher, the kitchen is often the hottest room in the home and the R/F's door is frequently opened during cooking when the oven is hot. All these factors add to the inefficiency of the indoor refrigerator (lower COP relative to a similar window R/F) and increase its electricity consumption.

The latent heat of fusion of water is (from ice to water) 80 calories of heat per gram and the latent heat of vaporization is (from water to vapor) 540 Calories/Gram. That means, at one atmosphere of pressure, water will absorb about 550 calories of heat per gram when changing from water at 100° C. to water vapor at 100° C. (and vice versa). And it will absorb about 80 calories when changing from ice at 0° C. to water at 0° C. (and vice versa). To save electricity, in the summer, the window R/F freezes water at night when the outdoors is cold. During the day when it is hot outdoors, the ice that was frozen the previous night is melted to aid in keeping the refrigerator compartment cool.

BRIEF SUMMARY OF THE INVENTION

One object of this invention is to provide a thermos that can be attached to the front of a window A/C for storing food and perishables at a low temperature.

Another embodiment of this invention is directed to an R/F for home use having its front indoors and its condenser coil outdoors to save electricity whenever the outdoors is colder than indoors.

The primary object of this invention is to provide for a convenient R/F that takes less indoor space and is more energy efficient (consumes less electricity) than a regular indoor R/F.

Another object is to provide for a synergistic hybrid window refrigerator and heat pump device that warms the home first by extracting heat out of the refrigerator and freezer compartment before using its outdoor evaporator.

Another object is to provide for a synergistic hybrid window refrigerator and heat pump device that has its two heat exchangers outdoors in thermal contact to maximize heat exchange between them. It is to be understood that In the summer the heat pump's outdoor heat exchanger is a condenser and in the winter, an evaporator.

Another object is to provide for a synergistic energy efficient hybrid window refrigerator and heat pump device that uses the outdoor temperature difference between day and night and the latent heat of water (both fusion and vaporization) to increase heating and humidity during cold winter nights and cooling and dehumidifying during hot summer days.

Another object is to reduce indoor heat and noise by placing the back of the R/F (the source of heat and noise) outdoors.

Another object is to extend the refrigerator's life by reducing its workload at night or whenever it is colder outdoors than in the kitchen.

Another object is to provide a window R/F whose internal size/volume can be adjusted to conserve energy. In the summer, the size is reduced; and in the winter, it is expanded, without consuming additional electricity.

Another object is to provide an R/F that does not work against the A/C in the summer by heating the home.

Still another object is to increase the stability of the heavy window A/C by attaching a small refrigerator, freezer, or thermos to its front (indoors) to act as a counterweight or anchor, thus reducing the likelihood of the A/C falling outside of the window.

Other objects and advantages will become apparent from the following descriptions, examined in connection with the accompanying drawings, wherein, by way of illustration and example, an embodiment of the present invention is disclosed.

A window R/F comprising: a window or an opening between the indoors and the outdoors, and an R/F (similar to a regular window A/C) having its front facing indoors and its condenser coil (hot side heat exchanger) set outdoors, thereby reducing its electricity consumption whenever the outdoors is colder than the indoors.

For example, it can be assumed that the indoor temperature is 75° F. (75 degrees Fahrenheit), the outdoor temperature is 40° F., and it is desired that the inside of the freezer be −5° F. (it's presently at +5° F.). The indoor freezer uses electricity to transfer the heat from its inside, where it is +5° F., to the outside of it, where it is 75° F. (75−5=70); The window freezer uses electricity to transfer the heat from its inside, where it is +5° F., to the outdoors, where it is 40° F. (40−5=35). Obviously, the window freezer's workload is smaller than that of the indoor freezer, and it is more efficient (has a higher COP). This would be comparable to a window A/C having to cool a home when the outdoor temperature is 85° F. as opposed to 120° F.

In addition, a window refrigerator gains heat more slowly because its back is outdoors, exposed to cold air. The colder the outdoors is, the longer it takes for the window R/F's insulated box to gain heat. The outer metal skin (outdoors) of the R/F will get cold in winter, so it is necessary to have an insulated skin on the front (indoors) of the R/F to minimize heat gain.

In addition, the window R/F may have one or more gated apertures or conduits with one end of the conduit exposed to the inside of the R/F and the other end exposed to the outdoors to allow controllable heat transfer from inside of the R/F to the outdoors in winter when the outdoors is colder than the inside of the R/F. When the gate of the conduit is open, air may be exchanged between the two areas and when the gate is closed, the separate areas are insulated and there is no exchange of air.

As stated previously, in the winter when the outdoors is colder than the inside of the R/F, the R/F can use the outdoor cold air to cool its inside (instead of electricity) by allowing outdoor cold air into the R/F through one or more gated conduits. Each conduit has a gate that seals and unseals the conduit, depending on the temperatures of the outdoors and the inside of the R/F. When closed, the gate seals and insulates the conduit, preventing any heat transfer between the outdoors and the inside of the R/F. A fan may be placed in the conduit to accelerate the heat transfer through the conduit when the gate is open. To prevent frosting, the fan may continuously rotate (at a very slow rate, even when the gate is closed).

A thermostat, a more sophisticated electronic device, or a computer chip compares the temperature inside the R/F to the outdoors. If the inside of the R/F is warmer than a preset threshold, and the outdoors is colder than the inside of the R/F; then the thermostat opens the passage (gated conduit) to allow outdoor cold air into the R/F. There can be a similar thermostat-controlled passage between the freezer and the refrigerator compartments, allowing controllable heat transfer between the refrigerator and freezer.

For summer energy conservation, the Window R/F has an auxiliary evaporator that is activated by a timer that turns it on at night and shuts it off during the day. Once activated, it freezes water at night, when the outdoor temperature is mild, in a sealed cooling chamber behind the refrigerator compartment. The ice is then melted during the day to aid in cooling the inside of the refrigerator compartment thereby conserving electricity. Optionally the cold dry air of the cooling chamber may be released indoors to keep the home cool and dry during the hot days.

Additionally a heat pump may be added to or incorporated within the window refrigerator to provide economical indoor cooling (and dehumidifying) during the summer and heating (and humidifying) during the winter by taking advantage of the latent heat of water (fusion and vaporization) and the outdoor temperature difference between day and night.

DETAILED DESCRIPTION OF THE INVENTION

Detailed descriptions of the preferred embodiment are provided herein. It is to be understood, however, that the present invention may be embodied in various forms. Therefore, specific details disclosed herein are not to be interpreted as limiting, but rather as a basis for teaching one skilled in the art how to employ the present invention in virtually any appropriately detailed system, structure, or manner.

Figure 1:
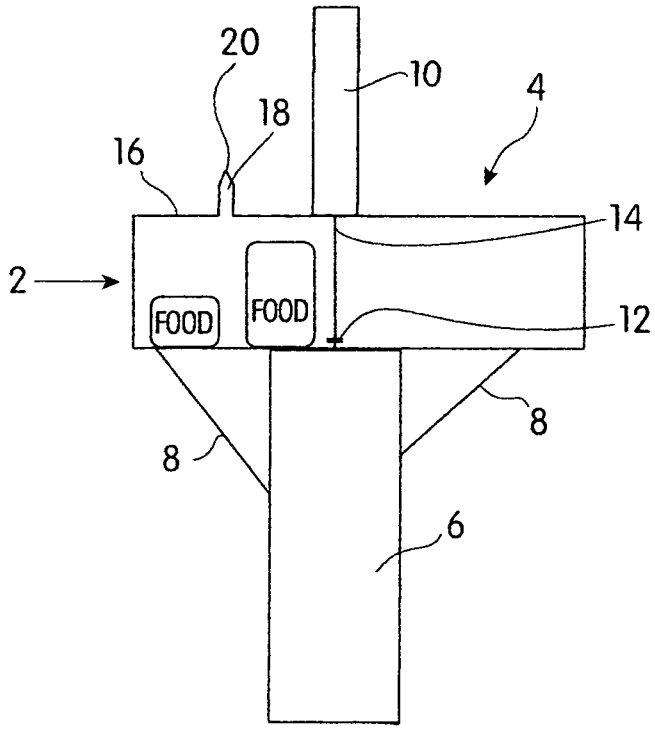
FIG. 1 is a cross-sectional side view of a thermos attached to the front of a window A/C.

A first embodiment is described with reference to FIGS. 1-3. FIG. 1 is a cross-sectional side view of a thermos 2 attached to the front of a window A/C 4. In this specification, "thermos" means a storage area for food and other perishables. The thermos 2 is attached by two screws to a window A/C 4. The A/C 4 is mounted on the wall 6 and is supported by a supporting rod 8 at the bottom and the window sash 10 at the top. Instead of using screws, the thermos 2 may be attached to the A/C 4 by other means, such as glue or a magnet. The thermos 2 has a large opening 12 in its back wall 14. There may be different pre-cut perforations on the wall 14 to enable the user to cut it to fit different styles of A/C units 4. The large opening on the wall 14 lets the cold air into the thermos 2. The thermos 2 has a top lid 16 with a handle 18. The handle 18 has an opening 20 to let excess air out of the thermos 2. Like the window A/C 4, the thermos 2 may have one or more supporting rods 8 to hold it firmly in its place and support its weight when it is filled with food and other perishables. Additionally, the thermos 2 may act as a counterweight for the A/C 4, helping to hold it firmly in place to prevent it from falling outside of the window 10.

Figure 2:
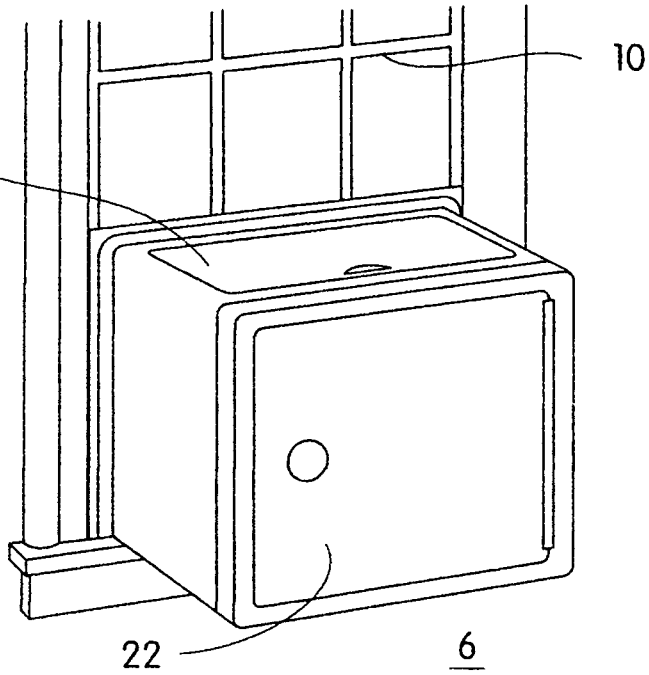
FIG. 2 is an elevational perspective view of a thermos attached to the front of a window A/C. The thermos has its gate and top closed.
Figure 3:
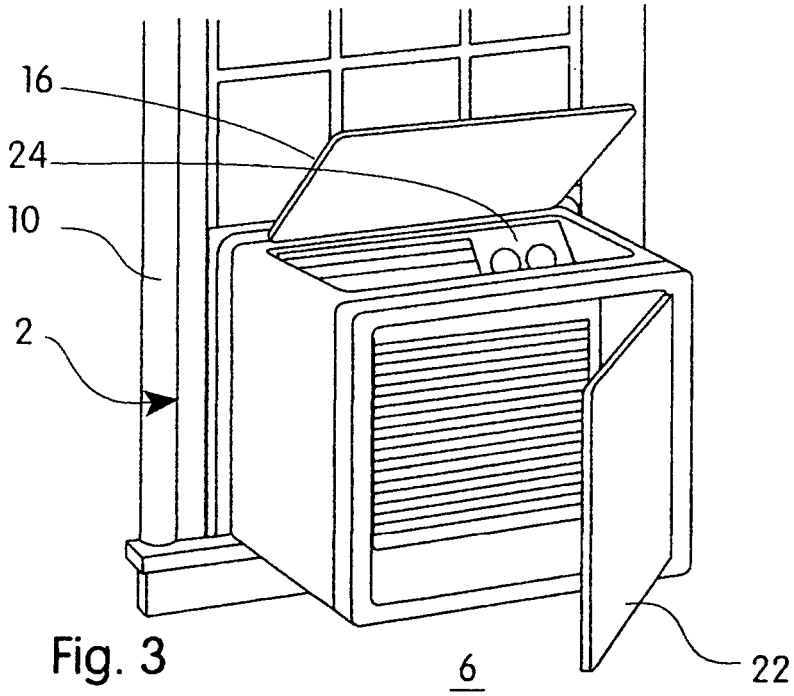
FIG. 3 is an elevational perspective view of a thermos attached to the front of a window A/C. The thermos has its gate and top open.

FIGS. 2 and 3 are elevational perspective views of the thermos 2 attached to the front of the window A/C 4. It has a top lid 16 and a front door 22 to allow easy access to the A/C's 4 control panel 24 and the food.

Figure 4:
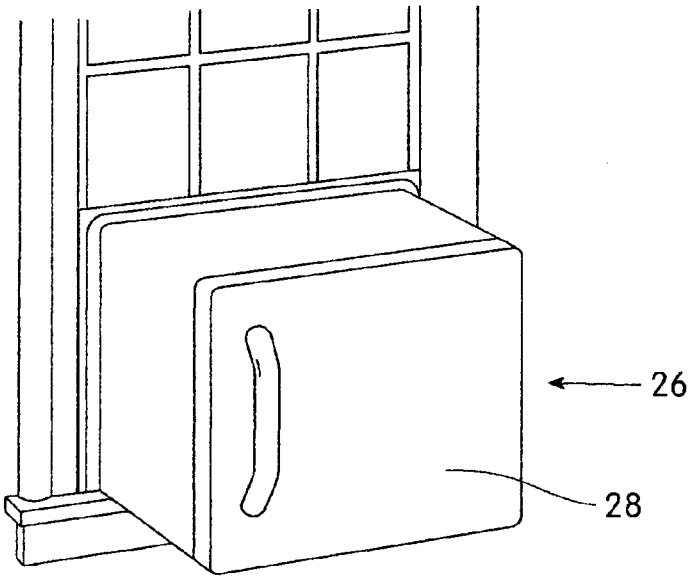
FIG. 4 is an indoor elevational perspective view of a standalone small size window R/F.
Figure 5:
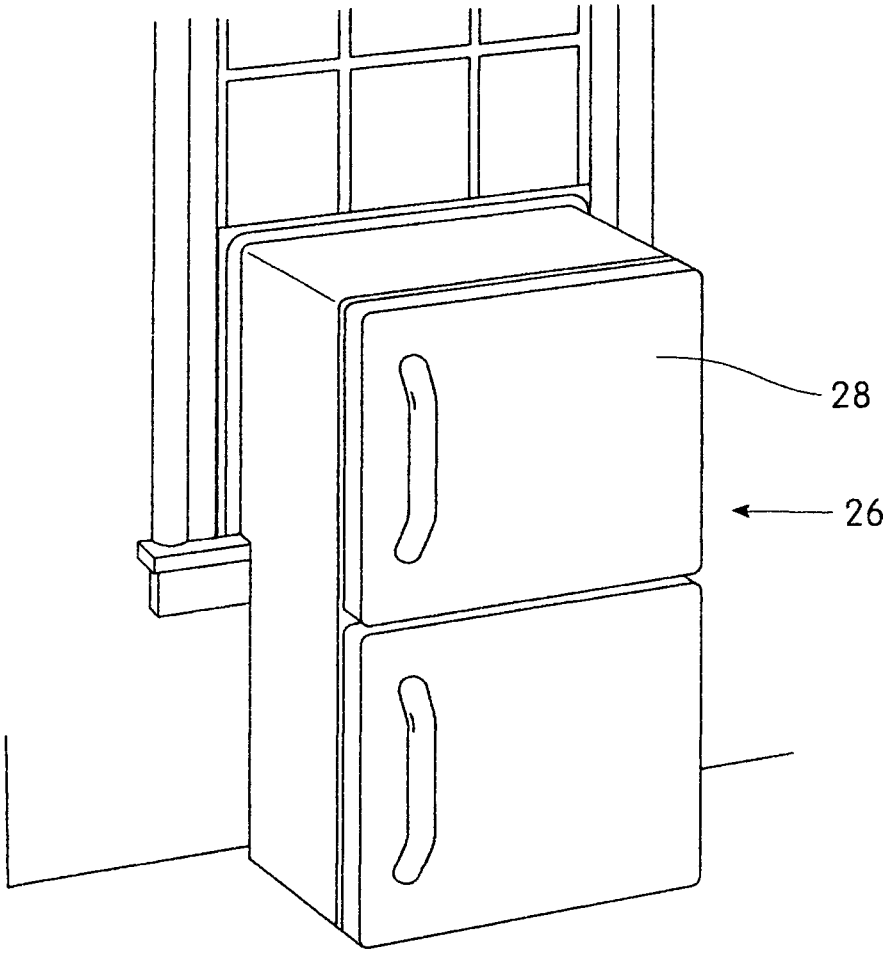
FIG. 5 is an indoor elevational perspective view of a standalone full size window R/F standing on the floor.
Figure 6:
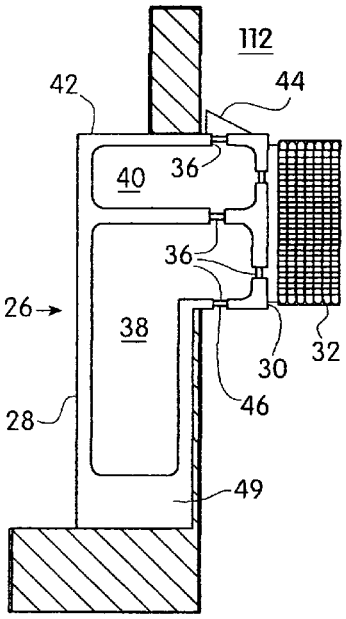
FIG. 6 is a cross-sectional side view of a full-size window R/F having a large condenser coil at its back (outdoors).
Figure 9:
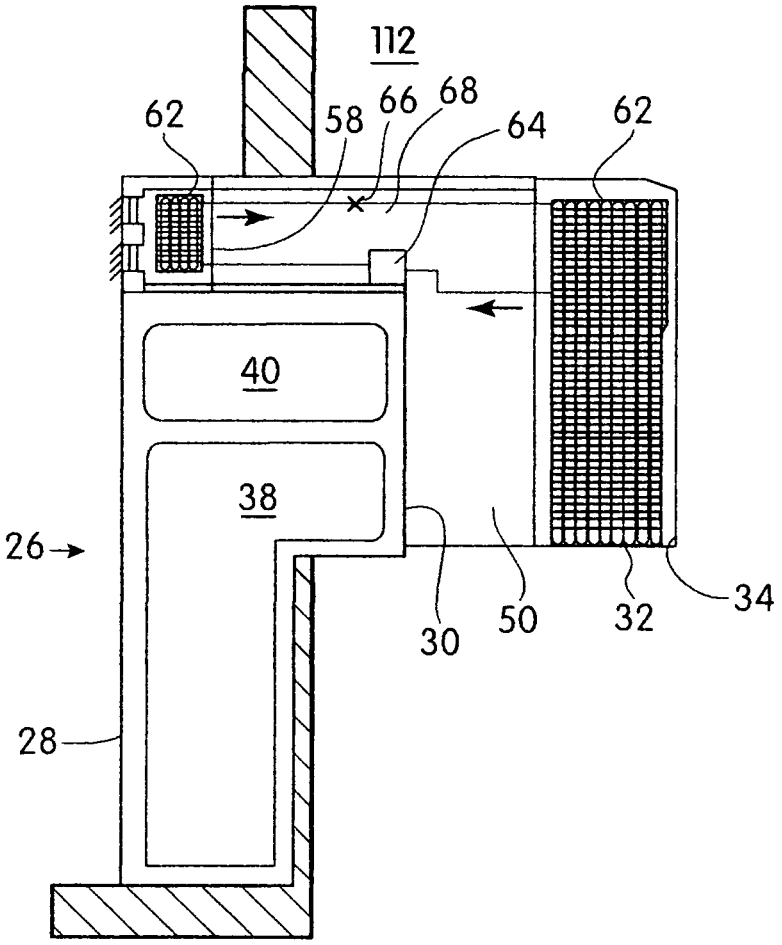
FIG. 9 is similar to FIG. 7 having an auxiliary heat pump on top of it.
Figure 10:
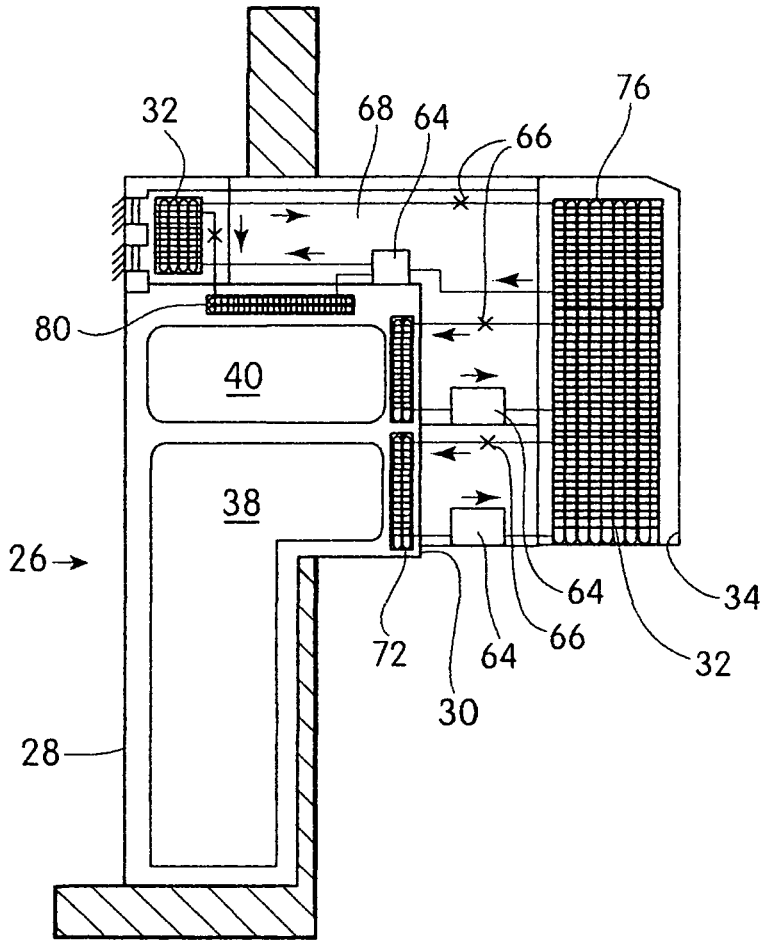
FIG. 10 is similar to 9, having on its top a heat pump with two evaporators, one inside the R/F and the other outdoors.

A second embodiment of this invention is described with reference to FIGS. 4-20. FIGS. 4 and 5 are perspective views of R/Fs 26 of this invention. FIGS. 6-10 are cross-sectional side views of window R/Fs 26 with their fronts 28 indoors and their backs 30 outdoors. In FIG. 6, the condenser coil, or hot side heat exchanger 32 (condenser), is outdoors, exposed to snow and rain. Optionally, the outdoor heat exchanger 32 may have a non-airtight, water-resistant cover 34 as shown in FIGS. 9 and 10 to protect it from direct sunlight, rain, or snow and enhance its outdoor appearance. An air fan is another optional enhancement which can be used to force the air through the heat exchanger 32 (in a way similar to that of a car's radiator). As shown, there are several gated conduits 36 (or apertures) that allow controllable heat transfer from the inside of the refrigerator 38 and freezer 40 compartments to the outdoors, only in winter, when the outdoors is colder than the inside of the R/F 26. One of the gated conduits 36 is at the top 42 and has a protective cover 44 to prevent water from seeping into the freezer compartment 40. A gated conduit 36 between the refrigerator 38 and freezer 40 compartments allows controllable heat transfer between the two compartments. One or more electronic devices, computer chips, or thermostats (not shown) control the gated conduits 36 and open or close the gates 46, depending on the temperature settings of the different compartments and the outdoor temperature. The heavy motor, compressor, and other electromechanical components are in a housing 49 at the bottom of the R/F 26.

Figure 7:
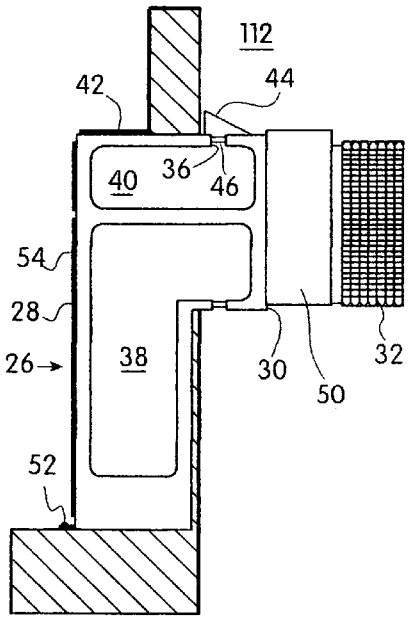
FIG. 7 is similar to FIG. 6, showing a full-size window R/F housing its heavy and noisy electromechanical components, such as its compressor, pump, and condenser, outdoors behind the condenser coil.

FIG. 7 is similar to FIG. 6 except that its motor, compressor and other electromechanical components are in an outdoor housing 50 outdoors in front of the condenser 32. Since these parts are heavy, screws 52 or other means may be necessary to secure the window R/F's 26 position. Although the refrigerator 38 and freezer 40 compartments are insulated, they will still gradually gain heat. The warmer the outside of the R/F 26 is, the faster it will gain heat. When the outdoors is colder than the indoors, a window R/F 26 (with its back 30 outdoors) gains heat more slowly than a similar indoor refrigerator. The outer metal skin of the window R/F 26 is heat conductive and gets quite cold at night or whenever it gets cold outdoors. Therefore, it is advantageous to have an insulation coating 54 on the front 28 (indoor) side of the R/F 26 to reduce heat gain by the R/F 26 (conserve energy) and keep the home warm simultaneously.

Figure 8:
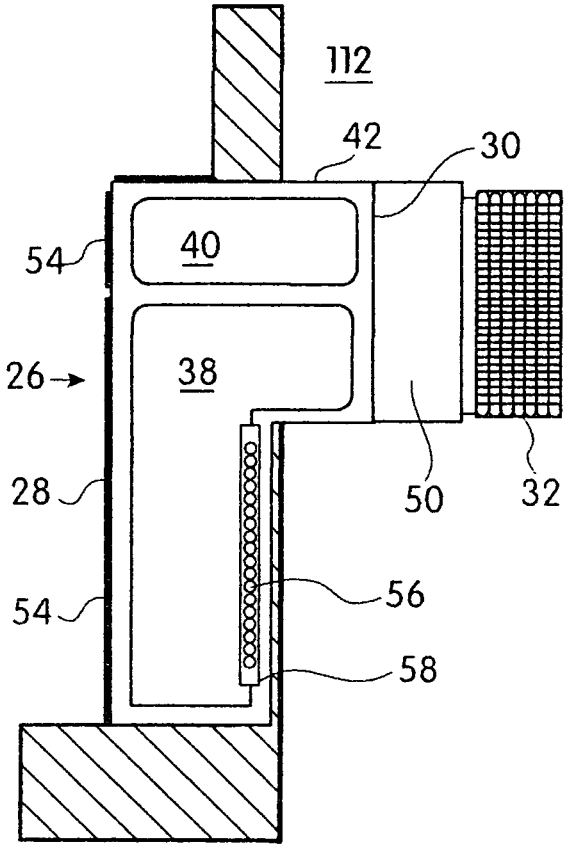
FIG. 8 is similar to FIG. 7 having an auxiliary cooling chamber in the back of its refrigerator compartment to provide additional cooling during hot days.

FIG. 8 is yet another embodiment, having an auxiliary evaporator 56 behind the refrigerator compartment 38. During the summer the user turns an auxiliary compressor (not shown) that circulates refrigerant into an auxiliary evaporator 56 to conserve energy. During the night when it is relatively cold outdoors, an automatic timer activates a compressor connected to the auxiliary evaporator 56, to circulate refrigerant inside the auxiliary evaporator 56 to freeze the ice inside the cooling chamber 58. During the day when it's relatively warm outdoors, the timer deactivates or turns off the compressor to let the frozen ice melt in the cooling chamber 58. The ice-chilled cooling chamber 58 provides extra cooling during peak hours of the day when it is hot outdoors without consuming additional electricity during daytime hours. Using lower-priced, off-peak electricity at night instead of higher-priced peak electricity during the day conserves energy and reduces congestion of the electric supply grid. In essence, ice energy acts as a cold thermal battery that is charged at night to provide cooling during peak hours of the day. In addition since the outdoor temperature is colder at night than day time, the window R/F 26 can freeze the ice with less electricity at night because its condenser coil 32 is outdoors.

FIG. 9 is yet another embodiment, having an auxiliary heat pump 68 on top of it. The heat pump 68 may have its own independent compressor or use the same compressor as the window refrigerator. The heat pump 68 (as shown) has two heat exchangers 62, one at its front (indoors) (heating/cooling chamber) and another at its back (outdoors). When it is cold outdoors (as shown), the indoor heat exchanger 62 is a condenser (to blow warm moist air indoors) and its outdoor heat exchanger 62 is an evaporator—the arrows indicate the direction of the refrigerant when it's cold outdoors. In the summer, the cycle is reversed—the refrigerant flows in the reverse of the direction indicated.

Ideally, the heat pump's outdoor heat exchanger 62 (in the summer it is a condenser and in winter it is an evaporator) is in close proximity and makes many thermal contacts with the outdoor condenser 32 of the R/F 26 to maximize heat exchange between the two outdoor heat exchangers 32, 62. During the summer, both outdoor heat exchangers 32, 62 are condensers. In winter, the outdoor heat exchanger 62 of the heat pump 68 is an evaporator. By exchanging heat with the R/F's 26 outdoor condenser 32, the evaporator is kept warm (which saves electricity) and the outdoor condenser 32 is kept cool (which also saves electricity).

FIG. 10 is similar to FIG. 9. As indicated, the heat pump 68 has an auxiliary refrigeration loop with an evaporator 80 in close proximity of the freezer compartment 40. When the heat pump 68 is turned on to warm the home, the refrigerant flows through the compressors 64, condensers 32, expansion valves 66 and evaporator coils 80, 76 and 72, in the direction indicated by the arrows. In the summer the direction of the refrigerant flow inside the heat pump 68 is reversed (not shown) and the heat pump 68 acts like a window air conditioner. When the heat pump 68 is on (to warm the home in winter), and the freezer compartment 40 needs to get cooled, it will first activate the heat pump's 68 evaporator coil 80 that is in close proximity to the freezer compartment 40. Once the freezer compartment 40 gets sufficiently cold and its temperature reaches below a set threshold, if additional heating is needed, the heat pump's 68 thermostat deactivates that loop, and activates the loop with an outdoor evaporator 76.

In this manner the heat from the inside of freezer (or refrigerator or both) compartment 40 is first transferred into the home to cool the R/F's 26 interior and warm the home simultaneously. Once the R/F 26 has been cooled sufficiently, if additional heating is needed, it then will transfer additional heat from the outdoors to the interior of the home (like a regular heat pump). In addition the computer chip or the thermostat may incorporate a program that automatically activates different refrigeration loops depending on the temperatures of the inside of the refrigerator 38 and freezer 40 compartments to minimize electricity consumption under different weather conditions and different refrigerator/freezer settings. As stated previously, the outdoor evaporator coil 76 of the heat pump 68 is in thermal contact with the outdoor condenser 32 of the window R/F 26 so that the two outdoor heat exchangers 32, 76 can rapidly exchange heat and normalize each others temperatures quickly.

Figure 11:
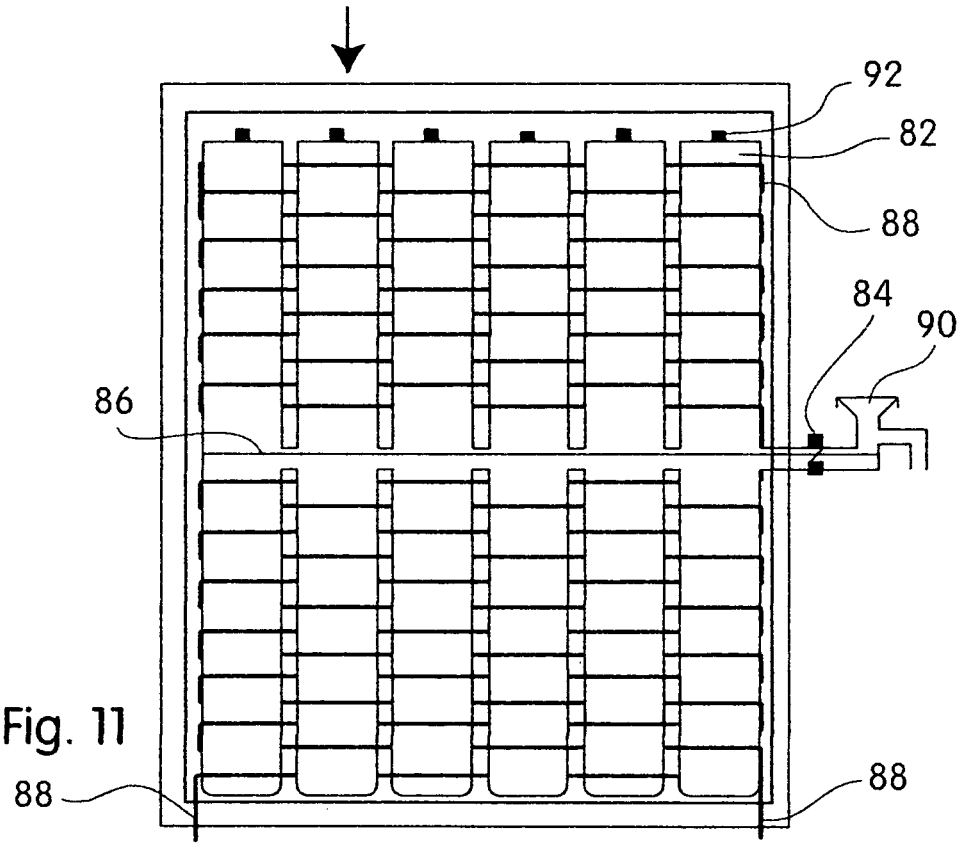
FIG. 11 is an enlarged elevational side view of the cooling (or heating) chamber of FIG. 8.
Figure 12:
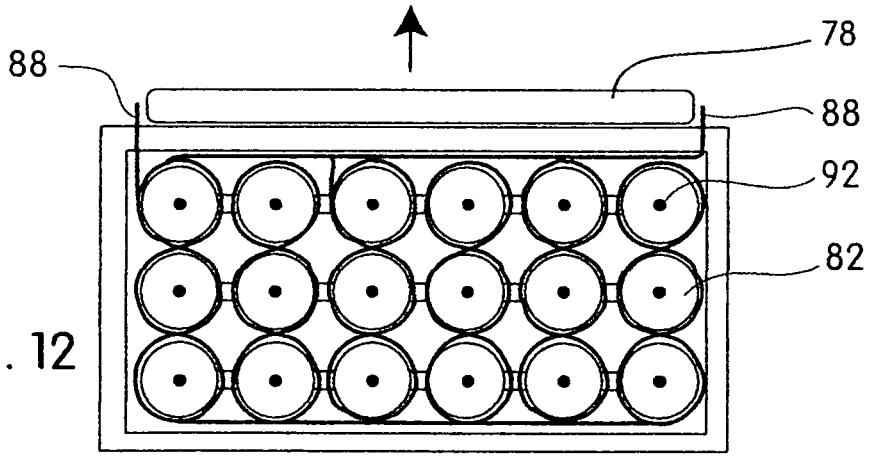
FIG. 12 is an enlarged elevational top view of the cooling (or heating) chamber of FIG. 11.

FIGS. 11 and 12 are magnified side and top views of the cooling chamber 58 of FIG. 8 (which can also be positioned in place of the indoor heat exchanger 62 of the heat pump of FIGS. 9 and 10). The latent heat of fusion and evaporation of water is known in the art. In addition to providing auxiliary cooling during summer months when installed behind the refrigerator compartment 38, the same chamber 58 may be used (when combined with a heat pump 68 and positioned in place of its indoor heat exchanger 62), to cool and dehumidify the home in the summer and heat-humidify the home in winter. The cooling chamber 58 contains many interconnected sealed heat conducting (for example aluminum) vertical pipes 82 that contain water to the level of the one-way valve 84. All the vertical pipes 82 are interconnected via a horizontal pipe 86 so that periodically water can be added to the chamber 58 as indicated. The water level in the pipes 82 will be quite different between winter and summer. For simplicity only one water level is indicated at the level of the one-way valve 84. The evaporator coil 88 (or condenser coil in case of a heat pump) is wrapped around the pipes 82 and cools (or heats) the pipes 82. There is an opening 90 from outside to periodically add water to the chamber 58 and makes it impossible to add more water than the level indicated. A one-way valve 84 prevents water or vapor from leaking out of the chamber 58. The pipes 82 have a pressure release valve 92 or a small opening on top to release excess air or vapor pressure inside the pipes 82. There are gaps between the pipes 82 for air passage as indicated.

In the summer, at night when it is relatively cool outdoors, a timer automatically activates a compressor 64 to circulate refrigerant into the auxiliary evaporator coil 88 wrapped around the pipes 82 inside the chamber 58. Optionally the user may activate the compressor 64 herself manually to store cool dry air. As a result, the water inside the pipes 82 freezes. As the water freezes it expands in the pipes 82 which for this reason are not filled to the top with water. During the day, the timer automatically shuts off the compressor 64, the refrigerant no longer circulates through the auxiliary evaporator 88 coils during the day time when it is hot outdoors. As a result the ice inside the pipes 82 gradually melts and cools the chamber 58. Optionally the chamber 58 may have an air inlet and outlet at its opposite ends with an air fan 78 blowing air out of the chamber 58 (when the chamber is placed in the position of the indoor heat exchanger 62 of the heat pump 68 of FIG. 9 or 10). The hot moist indoor air enters the chamber 58 and condenses on the cold ice-chilled pipes 82. As a result cool dry air exits the chamber 58 when the air inlet and outlet are opened and the fan 78 is activated.

In winter, the exact opposite occurs. The user turns on the auxiliary heat pump 68. During the day when it is relatively warm outdoors (relative to night time), a timer automatically activates a compressor 64 that circulates refrigerant in the auxiliary condenser coil 88 wrapped around the pipes 82 inside the chamber 58. Optionally the user may activate the compressor 64 manually before leaving home (to store moist hot air for later use). It also closes the chamber's 58 air inlet and outlet and turns off the fan 78 so that hot moist air cannot exit the chamber 58. As a result the water inside the pipes 82 gets hot and some of it vaporizes. The vapor's pressure opens the pressure release valve 92 on top of the pipes 82 releasing vapor into the chamber 58. During the night, when it is very cold outdoors, the timer automatically shuts off the compressor 64 to stop circulating refrigerant into the heat pump's 68 condenser 88 (or this may be done manually by the user when she needs additional heat) and opens the chamber's 58 air inlet and outlet and activates the fan 78. As a result the vapor inside the pipes 82 cools and releases heat as it condenses back to water. The cold dry winter indoor air enters the chamber 58 and the warm moist air of the chamber 58 exits it when the air inlet and outlet are opened and the fan 78 activated (during the cold winter nights or whenever the user activates it to use the stored moist heat inside the chamber 58).

Figure 13:
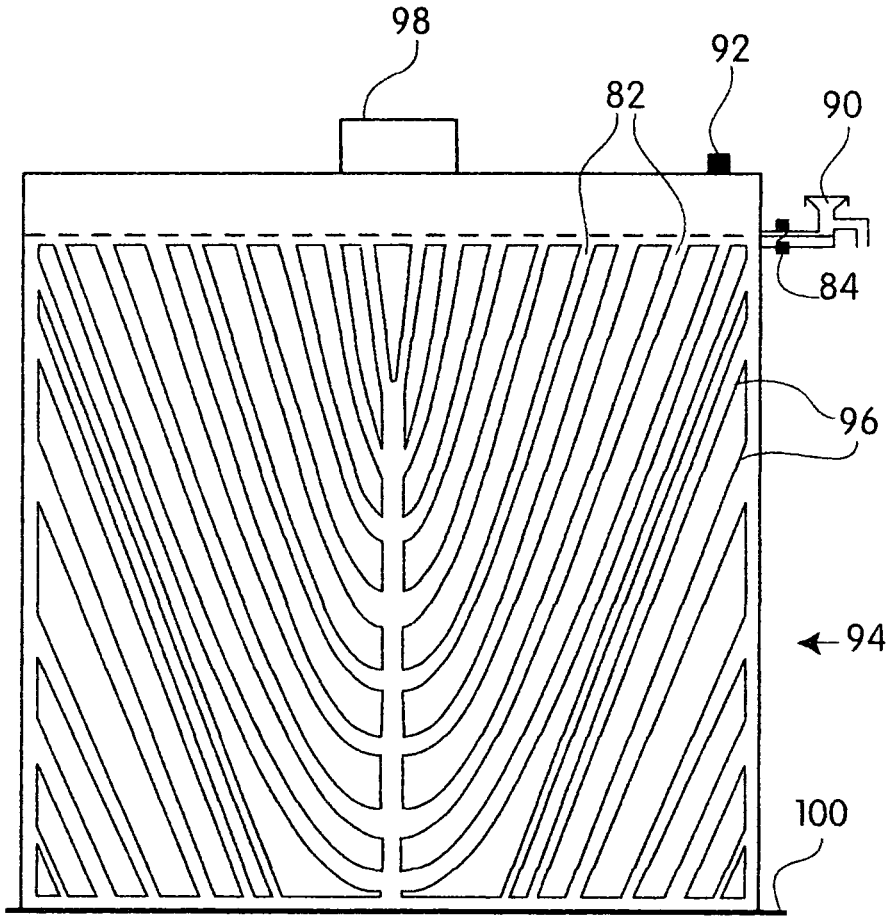
FIG. 13 is an elevational front view of a water-filled heat conductive grill similar to FIG. 11 but without a refrigerant coil.

FIG. 13 is a side view of a water-filled heat conductive grill 94 similar in operation to the cooling chamber 58 shown in FIGS. 11 and 12, but without a refrigerant heat exchange coil 88. The grill 94 is a separate unit from the window R/F 26 and is an inexpensive temporary replacement to the heat pump 68. As shown, it has many interconnected heat conductive pipes 96 with gaps in between the pipes 96 for air passage. The pipes 96 are filled with water through the opening 90 to the level of the one-way valve 84 which prevents water or vapor from exiting the grill 94. It has a pressure release valve 92 and a handle 98. The water level in the pipes 96 will be quite different between winter and summer. For simplicity only one water level is indicated at the level of the one-way valve 84. In addition the grill 94 has a sturdy stand 100 to keep it standing firmly in front of a blowing air fan.

In the summer, the grill 94 is filled with water to the indicated level and placed in an R/F's freezer compartment 40 overnight. During the hot daytime, the grill 94 is removed from the freezer 40 and placed or attached to the front of an air fan. As the warm humid indoor air passes through the cold grill 94 it melts the ice. As the ice melts it absorbs heat and cools the room. Furthermore the humid air condenses on the outside of the heat conductive (for example, aluminum) pipes 96, de-humidifying the indoor air.

During the winter, the grill 94 is again filled with water and this time placed on a stove for enough time for at least some of the water in the grill 94 to boil. The pressure release valve 92 may make a loud hissing noise as the high vapor pressure passes through it indicating the time to remove the unit from the stove. The grill 94 is then placed or attached to the front of an air fan to heat the home. As the vapor inside the pipes 96 cools by the cold dry indoor air, it condenses into water and releases heat. In addition, excess vapor is released through pressure release valve 92 humidifying the home.

Optionally, several heat-conductive water-filled grills 94 may be purchased simultaneously to enable the customer to continuously replace grills 94 once their vapor or ice has turned into water and their temperature normalized. Additionally, several grills 94 may attach or snap together to form one wide (thick) grill 94 for maximum heating or cooling during extreme cold or hot weather conditions.

Figure 14:
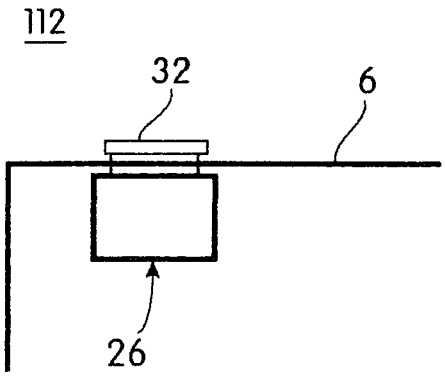
FIG. 14 is a diagrammatic top view of a window refrigerator having its condenser outdoors connected through two holes in the wall.
Figure 15:
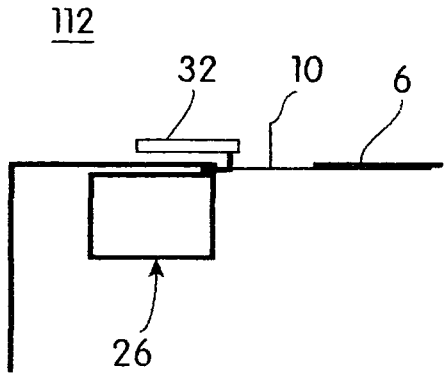
FIG. 15 is similar to FIG. 14, except that the holes are positioned under the window frame so as not to block the window.
Figure 16:
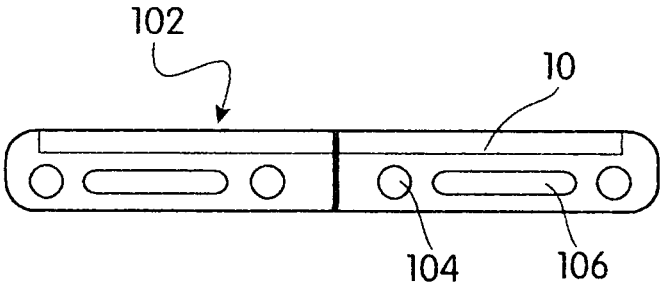
FIG. 16 is an elevational front view of a long, rectangular hollow strip with large holes in it that is inserted in the bottom of the window frame to support the window sash and eliminate the need to drill holes in the wall.

FIGS. 14, 15, and 16 relate to a situation where there is no available window or where there is a window 10, but it is important to not block it. The R/F's 26 condenser coil 32 can still be positioned outdoors through two holes in the wall 6 or by other means. This involves some technical skill and requires a technician to install the unit at the customer's site.

FIG. 14 is a top view of a window R/F 26 having its condenser 32 outdoors, connected through two holes in the wall 6.

FIG. 15 is similar to FIG. 14, except that the holes are positioned under the window frame so as not to block the window 10.

FIG. 16 is a long, rectangular hollow strip 102 with small 104 and large 106 holes in it that is inserted at the bottom of the window frame to support the window sash 10 (when window 10 is closed) and eliminate the need to drill holes in the wall 6. Preferably, the strip 102 is made up of two telescopic pieces that can slide horizontally to fit the width of any size window frame. The openings 104, 106 have plastic doors (not shown) that are closed when no cable or coil runs through them, thus providing thermal protection. When the window 10 is closed, the window sash 10 sits on the strip 102 and locks the strip 102 firmly into place.

Figures 17A, 17B, 17C, 17D:
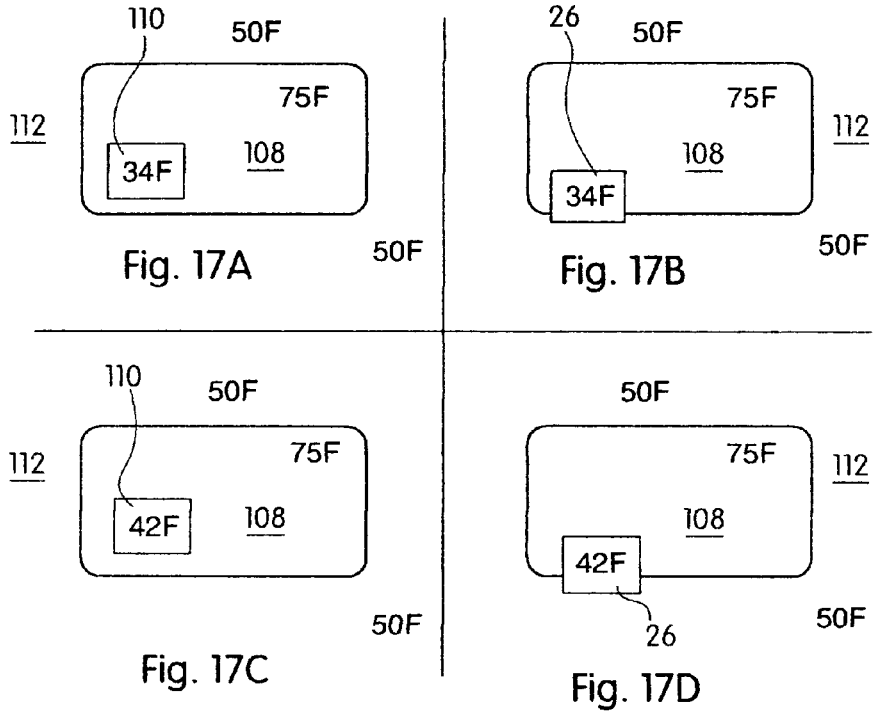
FIG. 17A is a diagrammatic top view of a room with an indoor refrigerator with its compressor idle (its inside is at an ideal temperature).
FIG. 17B is a diagrammatic top view of a room with a window refrigerator with its compressor idle.
FIG. 17C is a diagrammatic top view of a room with an indoor refrigerator with its compressor working.
FIG. 17D is a diagrammatic top view of a room with a window refrigerator with its compressor working.

FIG. 17A is a top view of a room 108 with a conventional indoor R/F 110. The temperature inside the indoor R/F 110 is 34° F. (the ideal temperature) and its compressor is off. As shown, the temperature of the room 108 is 75° F. and that of the outdoors 112 is 50° F.

FIG. 17B is similar to FIG. 17A, except that there is a window R/F 26 of the present invention in the room 108.

FIG. 17C is similar to FIG. 17A, except that the indoor R/F's 110 inside temperature is too warm (42° F.) and the compressor is now running to cool it. The indoor R/F 110 must now transfer heat from its inside (at 42° F.) to the room 108 (at 75° F.). The temperature gap (between its evaporator and condenser) is 75−42=33° F.

FIG. 17D is similar to FIG. 17C, except that the indoor R/F 110 is replaced by a window R/F 26 of the present invention. As in FIG. 17C, the window R/F's 26 inside temperature is too warm (42° F.) and its compressor 64 is running to cool it. The window R/F 26 must now transfer the heat from its interior (at 42° F.) to the outdoors 112 (at 50° F.). The temperature gap between its evaporator 60 and condenser 32 is only 50−42=8° F. (the temperature gap for FIG. 14C was 33° F.). There is obviously a much smaller workload on the window R/F 26, which results in saving electricity and prolonging the life of the R/F 26. In addition, since a part of the window R/F 26 (FIGS. 17B and 17D) is outdoors 112, it gains heat more slowly than does the indoor R/F 110 (FIGS. 17A and 17C).

The operation of the R/F 26 devices of this invention will be described with reference to FIGS. 18-20.

Figure 18:
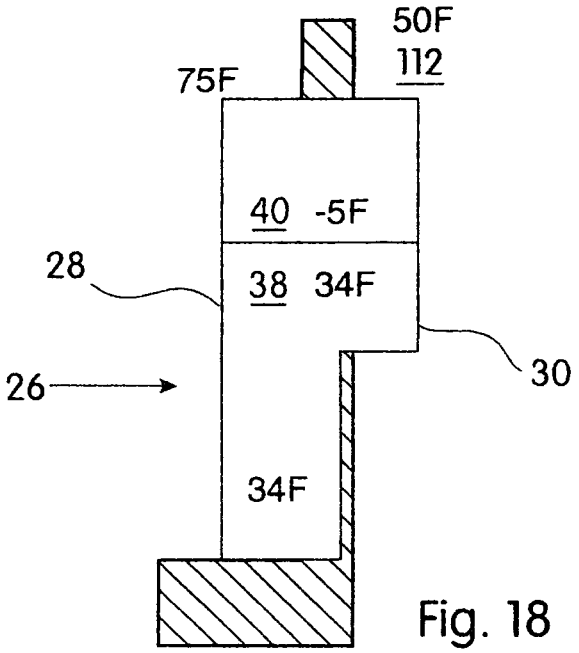
FIG. 18 is a cross-sectional side view of the window R/F showing an outdoor temperature of 50° F.

FIG. 18 is a side view of a window R/F 26 with its freezer 40 at −5° F. and its refrigerator 38 at 34° F. The outdoor temperature is 50° F. It should be noted that throughout this description and claims whenever the generic term R/F 26 is used, it refers to a device containing at least one of the refrigerator compartment 38 and the freezer compartment 40.

Figure 19:
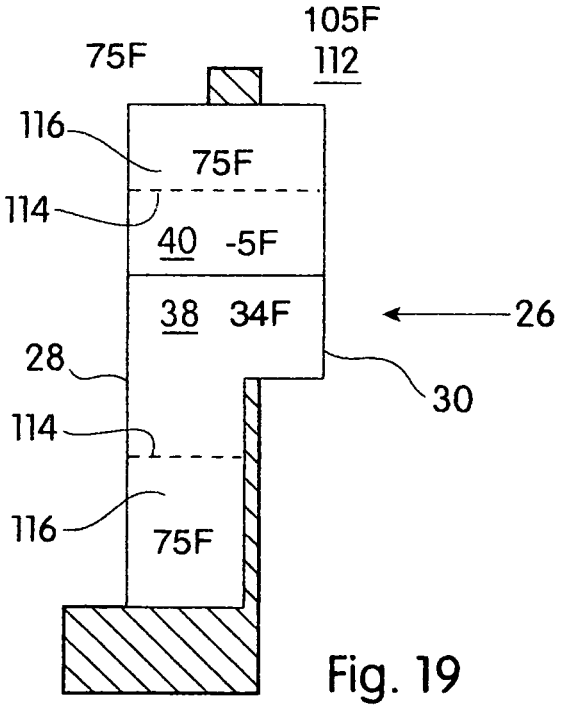
FIG. 19 is similar to FIG. 18, except that the outdoor temperature is 105° F. and two horizontal insulating barriers are being used to reduce the sizes of the refrigerator and freezer compartments.

FIG. 19 is similar to FIG. 18, except that the outdoor temperature is 105° F. Two removable, horizontal insulating barriers 114 divide the refrigerator 38 and freezer 40 compartments. As shown, the top portion of the freezer 40 and the bottom portion of the refrigerator 38 are cut off and can now be used as room temperature storage containers 116. Since the barrier 114 has cut off a portion of the refrigerator 38 and freezer 40, the window R/F 26 has less volume to cool; and it consumes less electricity in the summer heat. Now, more power (electricity) can be directed towards air conditioning to cool the inside of the home.

Figure 20A:
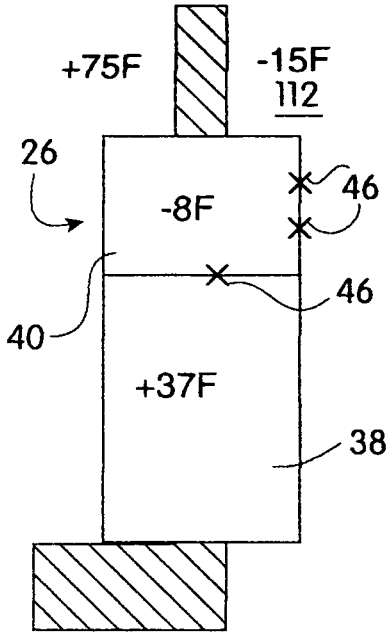
FIG. 20A is a cross-sectional side view of the window R/F when it is −15° F. outdoors. The R/F's compressor is idle and all the gates are closed to prevent heat transfer.

FIG. 20A is a side view of a window R/F 26 when the outdoor temperature is −15° F. The temperatures inside the refrigerator 38 and freezer 40 compartments are ideal and the window R/F 26 is idle. The gates 46 are closed, preventing heat transfer out of the R/F 26.

Figure 20B:
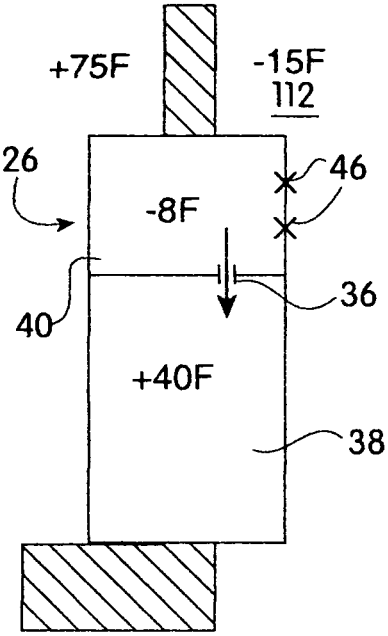
FIG. 20B is similar to FIG. 20A. Here the refrigerator compartment has gotten too warm and heat is being transferred out of the refrigerator into the freezer compartment (the arrow indicates the direction of the cold air flow) to cool the inside of the refrigerator.

FIG. 20B is similar to FIG. 20A, except that the refrigerator compartment 38 is too warm (40° F.). The gated conduit 36 is opened to allow cold air into the refrigerator compartment 38 from the freezer compartment 40 as indicated by the arrow.

Figure 20C:
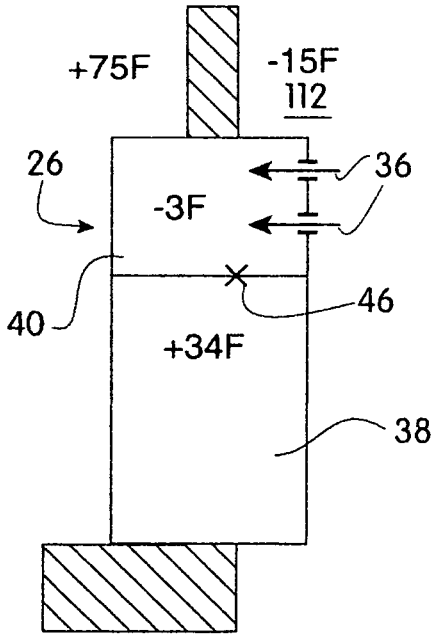
FIG. 20C is similar to FIG. 20B. Here the freezer compartment has gotten too warm and heat is being transferred out of it to the outdoors (the arrow indicates the direction of the cold air flow).

FIG. 20C is similar to FIG. 20B, except that the freezer compartment 40 is too warm (−3° F.). The gated conduit 36 is opened to allow cold air from outdoors (−15° F.) into the freezer compartment 40. The only electricity that is consumed is to run the electronic components and power to open and close the gated conduits 36.

The higher the COP the better, because more heat can be transferred with less work (electricity). The COP depends primarily on the temperature of the evaporator (inside the R/F 26) and the condenser 32 (the back of the R/F). The closer the two temperatures are to each other, the higher the COP. Therefore the colder the outdoor temperature gets, the closer it gets to the inside temperature of the R/F 26 and the higher the efficiency of the R/F 26.

Calculations for energy savings have been made for those instances when the A/C is on and the kitchen is colder than outdoors and it has been determined that there is no energy savings or any energy loss under these conditions. Since the condenser coil 32 of the R/F 26 is outdoors, it does not heat the inside of the home like an Indoor R/F does. An Indoor R/F works against the A/C warming up the home. But unlike an indoor R/F, a window R/F's 26 back is exposed to the outdoors' hot air. This increases the energy consumption of the window R/F 26 relative to the indoor R/F. My calculations indicate that the net effect is neutral, no energy (electricity consumption) savings or any energy loss occurs.

Low-income families do not have A/C or if they do, it may be old and not in proper working condition. When the A/C is off, the inside of the home is often warmer than the outdoors. This is due to the human activity and devices (lighting, TV, computer, hot water, etc) that generate heat which gets trapped in the building. In addition, the R/F 26 is placed in the kitchen near the oven. The kitchen is often the hottest room in the home and the R/F's 26 door is frequently opened during cooking when the oven is hot. Most people use the window A/C to cool their living space (not the kitchen). As a result the kitchen is often a few degrees warmer than outdoors.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

I claim:

1. A combination of an opening between indoors and outdoors in a building having an inside and an outside and a refrigerator device, in which the refrigerator device has a cooling compartment, a door, an evaporator coil, an outdoor temperature-sensitive device, and a condenser coil wherein the condenser coil is outdoors and there is a gated conduit between the cooling compartment and the outdoors such that when the gate is closed the conduit is insulated and the air on one side of the gate is prevented from exchanging with the air on the other side of the gate and wherein the outdoor temperature-sensitive device opens the gate whenever the temperature inside the refrigerator cooling compartment gets above outdoor ambient temperature and above a predetermined temperature and the outdoor temperature-sensitive device closes the gate whenever the outdoor temperature gets warmer than the inside of the refrigerator cooling compartment and wherein the cooling compartment has a removable insulating barrier which divides the compartment into a portion which is cooled and a portion which is not cooled, thereby decreasing the volume which is cooled during warmer summer season and saving electricity.

2. The combination of claim 1, wherein the refrigerator device contains a freezer compartment and there is a gated conduit between the freezer compartment and the outdoors such that when the gate is closed the conduit is insulated and the air on one side of the gate is prevented from exchanging with the air on the other side of the gate.

3. The combination of claim 1, wherein the opening is a window.

4. The combination of claim 3, wherein the window contains a frame and a sash.

5. The combination of claim 1 wherein the evaporator coil is adjacent to a reservoir and there is a heat-conductive phase-change material inside the reservoir, whereby the evaporator coil produces a solidified phase change in the phase-changing material in the reservoir at night when an ambient temperature outdoors is colder than during day and the solidified phase-change material will later be used to cool the cooling compartment during day when an ambient outdoor temperature is warmer than during night.

6. A combination of an opening between indoors and outdoors in a building having an inside and an outside and a refrigerator having a cooling compartment, a door, an evaporator coil, a time-sensitive device, and a condenser coil wherein the condenser coil is outdoors, wherein the evaporator coil is adjacent to a reservoir wherein the reservoir is adjacent to a heat-conducting grate for air passage and contains heat-conductive phase-change material inside the reservoir, and wherein the time-sensitive device controls the operation of the evaporator coil so that the evaporator coil produces a solidified phase change in the phase-changing material in the reservoir at night when ambient temperature outdoors is colder than during day and the solidified phase-change material will later be used to cool the cooling compartment during day when ambient outdoor temperature is warmer than during night.

7. The combination of claim 6 wherein the phase-change material is water and the solidified phase-change material is ice.

* * * * *